US011760609B2

(12) United States Patent
Bergeron

(10) Patent No.: US 11,760,609 B2
(45) Date of Patent: Sep. 19, 2023

(54) CLAMSHELL BUCKET ASSEMBLY

(71) Applicant: Raymond E. Bergeron, Trenton, MI (US)

(72) Inventor: Raymond E. Bergeron, Trenton, MI (US)

( * ) Notice: Subject to any disclaimer, the term of this patent is extended or adjusted under 35 U.S.C. 154(b) by 538 days.

(21) Appl. No.: 17/089,130

(22) Filed: Nov. 4, 2020

(65) Prior Publication Data

US 2021/0131058 A1 May 6, 2021

Related U.S. Application Data

(60) Provisional application No. 62/930,645, filed on Nov. 5, 2019.

(51) Int. Cl.
*B66C 3/00* (2006.01)
*E02F 3/413* (2006.01)
*B66C 3/02* (2006.01)

(52) U.S. Cl.
CPC ..... *B66C 3/005* (2013.01); *B66C 3/02* (2013.01); *E02F 3/4135* (2013.01)

(58) Field of Classification Search
CPC ... E02F 3/60; B66C 3/12; B66C 3/125; B66C 3/02; B66C 3/005; B66C 3/16
See application file for complete search history.

(56) References Cited

U.S. PATENT DOCUMENTS 369,842 A 9/1887 Delory
2,027,409 A * 1/1936 Weeks ..... B66C 3/02 37/461
2,725,996 A * 12/1955 Britton ..... E02F 3/4135 414/735
3,410,593 A 11/1968 Goodman, Jr.
3,413,029 A * 11/1968 Donovan ..... E02F 3/3681 294/68.23
3,920,137 A * 11/1975 McCain ..... E02F 3/4135 294/68.23
4,012,069 A * 3/1977 Carson ..... B66C 3/16 294/68.23
4,143,901 A 3/1979 van Huuksloot
(Continued)

FOREIGN PATENT DOCUMENTS

CA 3064360 A1 11/2018
JP 2003184123 A 7/2003

OTHER PUBLICATIONS

Canadian Examination Report for Appl. No. 3,098,169, dated Feb. 24, 2022, 6 pages.

*Primary Examiner* — Jessica H Lutz
(74) *Attorney, Agent, or Firm* — Dinsmore & Shohl LLP

(57) ABSTRACT

A dredging bucket having a head subassembly including an inner rotatable head and an outer head angularly supported by the inner head between level and tilted orientations. First and second opposing bucket halves supported by the outer head and pivotally actuating between closed and opened positions. A pair of T-links incorporated into spaced apart and coaxial pivot locations defined between the bucket halves, each of the T-links having a central stopping bar which, upon the bucket halves rotating to a maximum degree associated with the opened position, contacting end locations defined in upper edge profiles of the bucket halves in order to prevent further opening rotation.

15 Claims, 18 Drawing Sheets

(56) References Cited

U.S. PATENT DOCUMENTS

| | | | | |
|---|---|---|---|---|
| 4,379,675 | A * | 4/1983 | Muntjanoff | A01G 23/006 414/734 |
| 5,228,735 | A * | 7/1993 | Morrow, Sr. | E02F 3/47 294/68.23 |
| 5,501,024 | A * | 3/1996 | Bergeron | B66C 3/12 294/68.23 |
| 5,553,404 | A * | 9/1996 | Bergeron | B66C 3/12 37/340 |
| 7,810,260 | B2 | 12/2010 | Pope et al. | |
| 8,240,070 | B1 | 8/2012 | Phillips et al. | |
| 9,388,023 | B2 * | 7/2016 | Gauthier | E02F 3/47 |
| 9,452,912 | B1 * | 9/2016 | Bergeron | E02F 3/4135 |
| 10,308,484 | B2 * | 6/2019 | Bergeron | E02F 3/413 |
| 2013/0069383 | A1 * | 3/2013 | Sunde | B66C 1/427 294/198 |
| 2019/0062126 | A1 | 2/2019 | Scotto et al. | |

* cited by examiner

FIG. 25
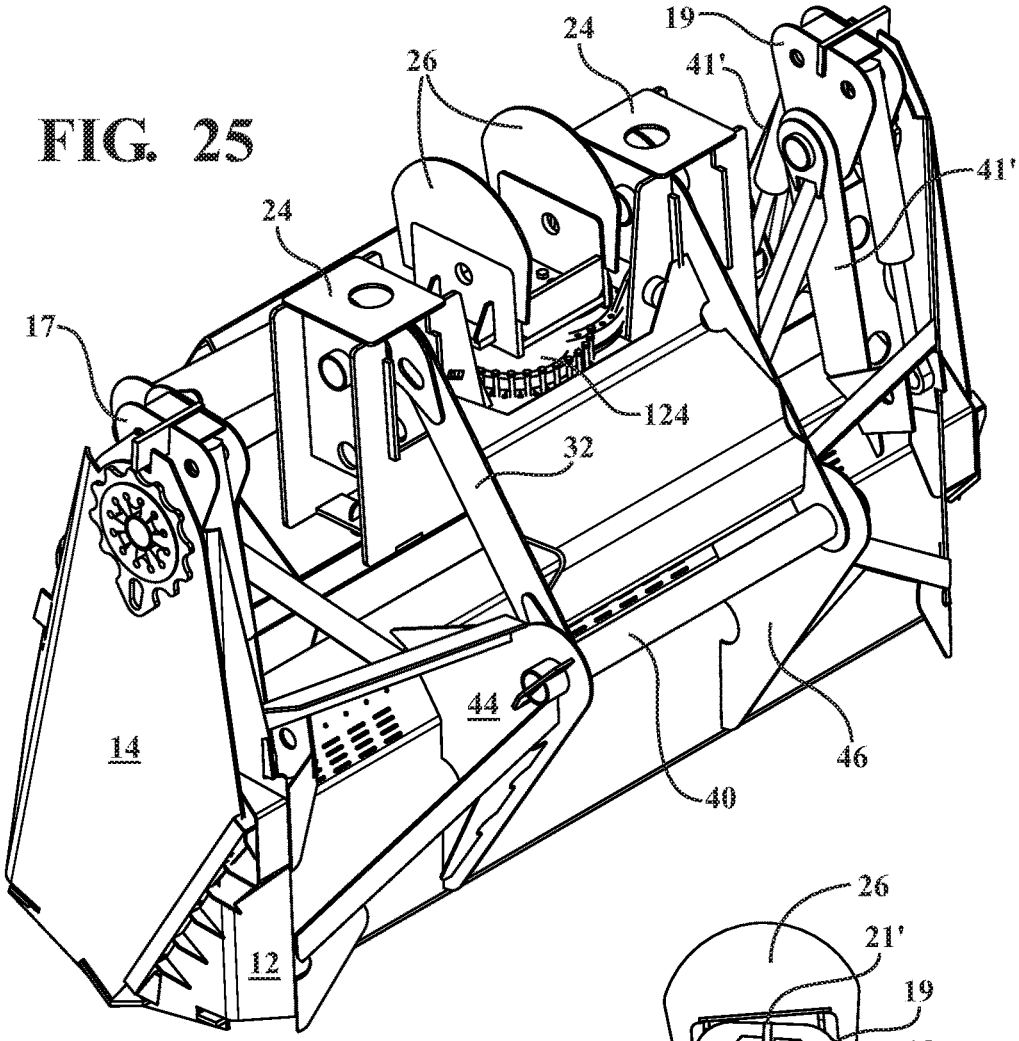
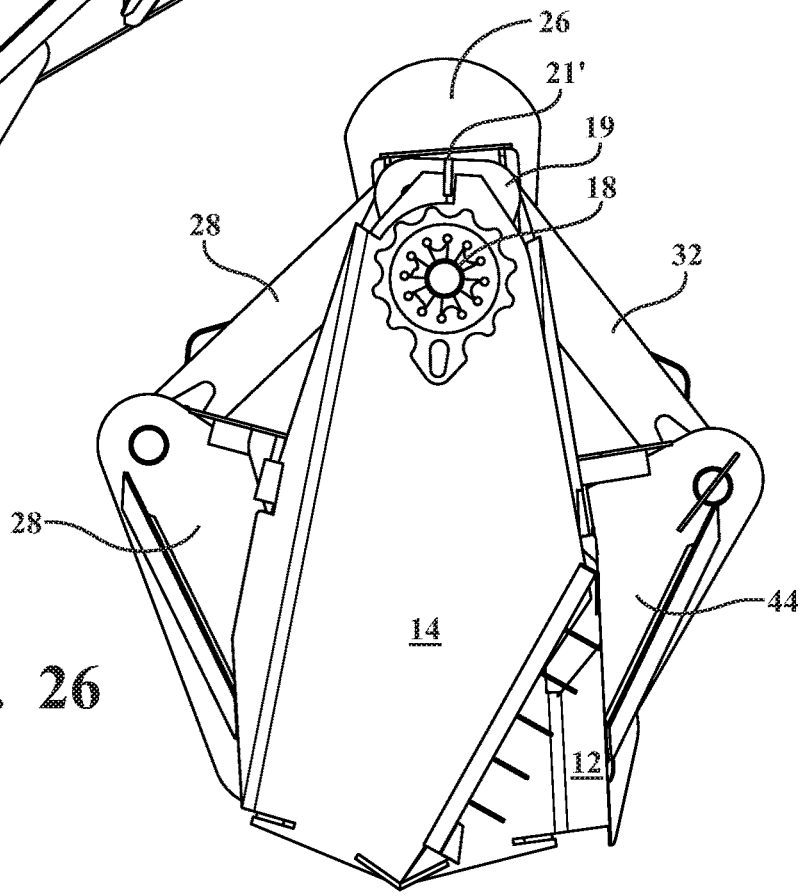
FIG. 26

CLAMSHELL BUCKET ASSEMBLY

CROSS REFERENCE TO RELATED APPLICATIONS

The present application claims the priority of U.S. Ser. No. 62/930,645 filed Nov. 5, 2020, the contents of which are incorporated by reference.

BACKGROUND OF THE INVENTION

The prior art is documented with examples of clamshell style dredging buckets. Non-limiting examples of these are shown in U.S. Pat. Nos. 10,308,484 and 9,452,912, both to Bergeron, and which teach first and second pivotally interconnected bucket halves and which are capable of being suspended from a crane cable or, in instances, from a first end of an articulating arm such as associated with an excavator.

Variants of the bucket designs can further include mechanical opening and closing of the clamshell halves about a common pivot point and through any arrangement of cables or chains connected directly to the bucket halves or to associated swing arms or brackets. The bucket halves can also be moved between the open and closed positions via the provision of hydraulic cylinders incorporated into the assembly, such as in cooperation with the support mounted brackets and/or swing arms. Alternatively, the individual cylinders can be substituted by a hydraulic pressure source or can be integrated into the crane or excavator to which the bucket assembly is attached or suspended.

Another more recent design of note is the clamshell bucket with aux-bail carriage assembly disclosed in US 2019/0062126 to Scotto et al. The aux-bail release mechanism operates such that movement of the chains is restrained, resulting in an auxiliary hook actuating the release mechanism in a smooth and controlled manner from a variety of angles and positions, while reducing or eliminating bucket roll from offset pulling. The release mechanism can include a carriage configured to translate along at least a portion of a mast and operatively connected to first and second clamshell portions such that movement of the carriage away results in rotation of the clamshell portions toward the open position.

SUMMARY OF THE PRESENT INVENTION

The present invention discloses a clamshell bucket assembly. More particularly, the present invention teaches a bucket assembly with improved forming techniques enabling weight reduction, in combination with improved positioning and welding of the arms and brackets to the bucket halves along at least one of side and end reverse bend locations for imparting a compressing loading vector to reduce instances of weldment fracture. In this manner, the present invention provides a bucket assembly with reduced weight along with minimization of tensile loading forces exerted on the weldments during operation of the bucket, thereby reducing incidences of weld failure.

The bucket assembly also incorporates a rotatably supported head subassembly with cylinder driven and angular adjustability of the bucket halves relative to a crosswise axis extending through the head sub assembly and in order to re-orient the bucket halves to accommodate any desired dredging operation, such as including forming angled or side slopes in a channel dredging operation.

Additional features include a pair of T-link components provided at upper opposite edges of the bucket halves. Each T-link includes a sleeve seating around a pivot support shaft configured at each end of the bucket half connection. The T-link includes a central pivoting stopping bar which, upon achieving a maximum outward pivoting the bucket halves, abuts an upper plate edge profile of each bucket half to define a maximum opening position, thus preventing over-extension of the bucket half drive cylinders. In this manner, the bucket halves are displaceable between open and closed positions for use in a sediment removal operation.

Other features include each of the bucket halves further exhibiting an increased width relative to length for establishing an over square footprint in order to increase sediment removal efficiency and profit by maximizing the amount of sediment removed per scoop. The bucket further enables reduced downward water pressure for lowering instances of turbidity during lowering of the bucket, as well as minimizing windrowing of material during closing of the bucket halves and return ascent from the water.

The bucket halves each further include an open center to increase lowering velocity of the bucket as it descends through the water to the sediment bottom allowing faster descent for more sediment removal scoops within a given time period. Other features can include incorporating dewatering vents with rubber seals into the tops of the bucket halves to assist in faster drain-off of water once the ascending and sediment filled bucket breaks the water surface. Additional features include the bucket halves being of a general scoop variety or, alternately, each further including a level cut edge profile for minimizing removal depth of sediment per scoop, and which occurs such as in instances where the primary objective is to either avoid over dredging or to remove toxic materials from a given area and as opposed to maximizing volumetric removal of sediment, thus reducing the overall costs of sediment removal.

BRIEF DESCRIPTION OF THE DRAWINGS

Reference will now be made to the attached drawings, when read in combination with the following detailed description, wherein like reference numerals refer to like parts throughout the several views, and in which:

FIGS. 23-25 present a series of perspective view of a bucket assembly according to a further related variant of the present invention; and FIG. 26 is a side illustration of the bucket assembly in FIG. 23 and better showing the combination of the T-links and bucket half support arms for supporting the first and second bucket halves between each of opened/separated and closed/overlapping positions.

DETAILED DESCRIPTION OF THE PREFERRED EMBODIMENTS

With reference now to the attached figures, the present invention discloses a series of related variants of a bucket assembly which provides a number of advantages over prior art clamshell bucket designs. According to the varying configurations of the bucket design described below, each includes a variation of angled or arcuately formed side and end surfaces which provides for increased strength along with concurrent reductions in overall weight.

Additional advantages of the present bucket designs also include minimizing tensile loading forces exerted upon the lower bracket weldments, thereby reducing incidences of weld failure which can result in fracturing the arms or brackets from the bucket during instances of the closing forces exerted by the submerged bucket halves being resisted by an object (rock, tree, etc.) which is captured between the leading edges of the bucket halves during a typical underwater sediment/dredging removal operation.

The construction of the buckets as described below provide a variety of additional advantages over existing designs, these including but not limited to reduced downward water pressure during lowering, thereby limiting turbidity (underwater clouds resulting from mixing of sediment with the water during lowering of the bucket). The design of the bucket further serves to maximize width relative to open length (termed an "oversquare" foot print) in order to increase sediment removal efficiency and profit by maximizing the amount of sediment removed per scoop, as well as minimizing windrowing (outward side flow losses of material occurring during closing of the bucket and return ascent above the water surface and which is in part prevented by the overlapping arrangement of the bucket half side plates in the closed position).

Other advantages include configuring an open center into the bucket design to increase lowering velocity of the bucket as it descends through the water to the sediment bottom (faster descent allowing for more sediment removal scoops within a given time period), as well as incorporating dewatering vents with rubber seals to assist in faster drain off of water once the ascending and sediment filled bucket breaks the water surface. The level cut construction of specific variants of the present bucket designs further serves to minimize removal depth of sediment per scoop, such as in instances where the primary objective is to either avoid over dredging or to remove toxic materials from a given area and as opposed to maximizing volumetric removal of sediment, thus reducing the overall costs of sediment removal.

Figure 1:
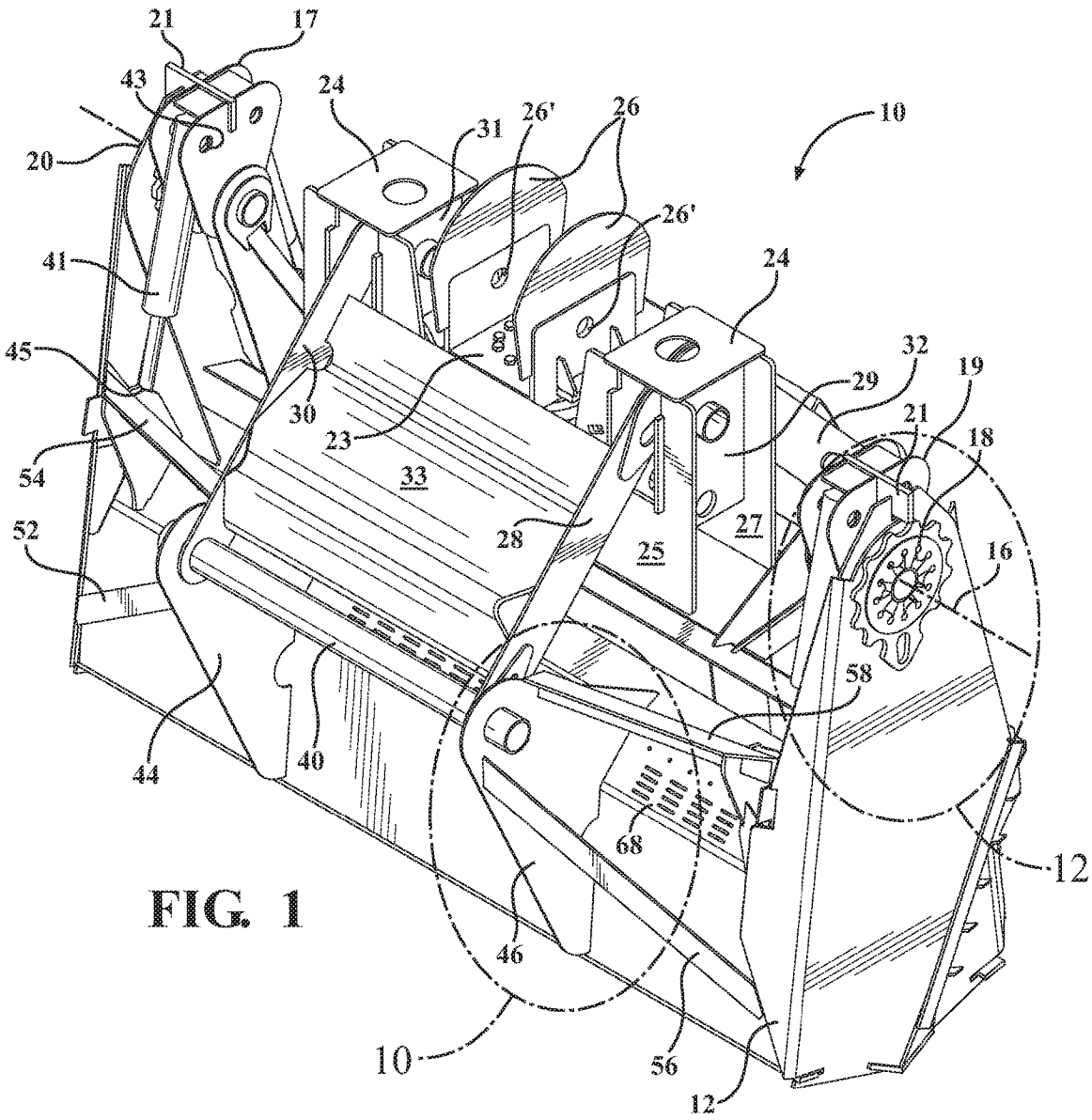
FIG. 1 is a downward looking perspective of a first variant of the clamshell dredging bucket according to the present invention.
Figure 2:
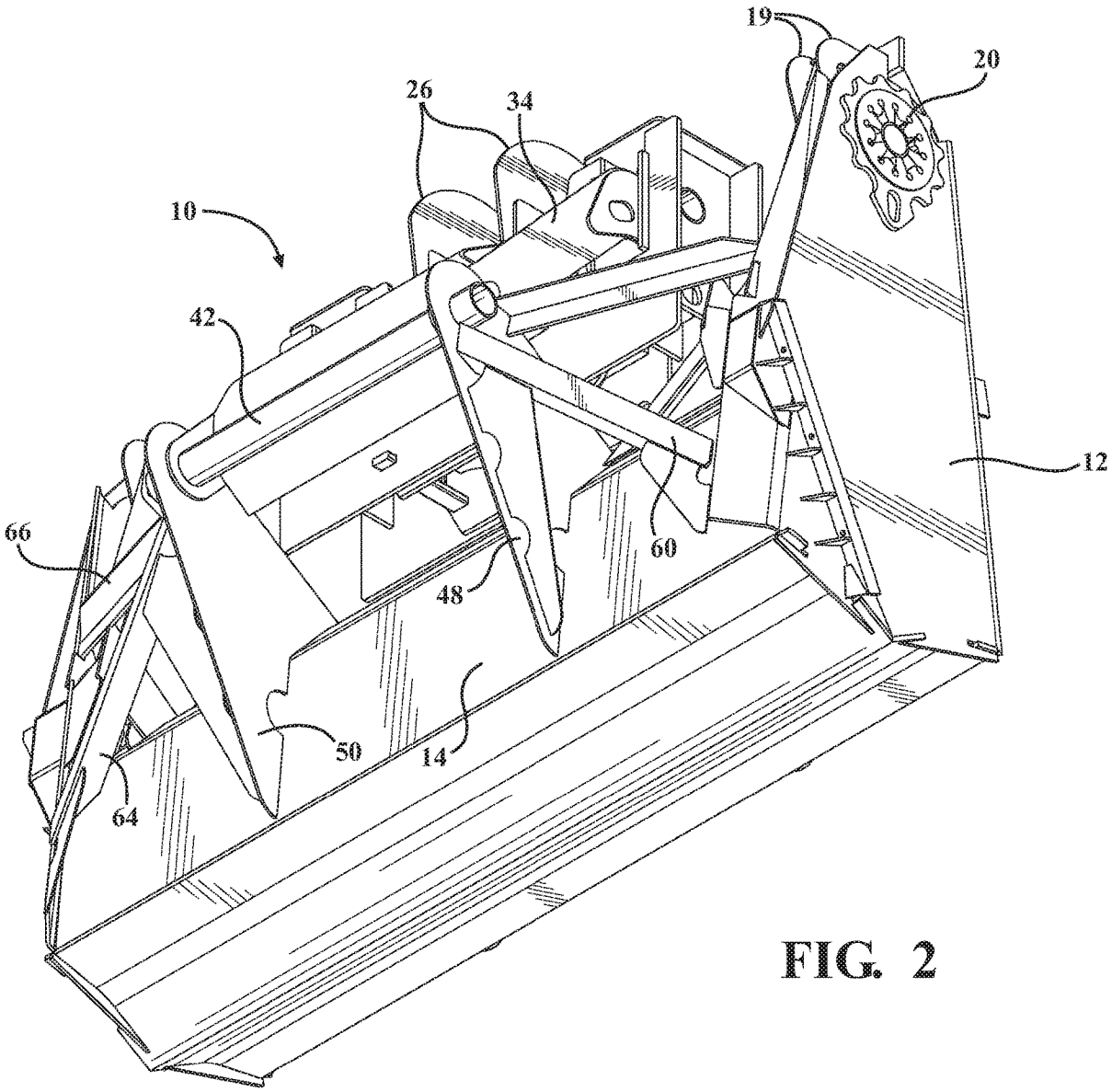
FIG. 2 is an upward looking perspective of the clamshell dredging bucket of FIG. 1 and further illustrating the improved shaping and weldment techniques.
Figure 3:
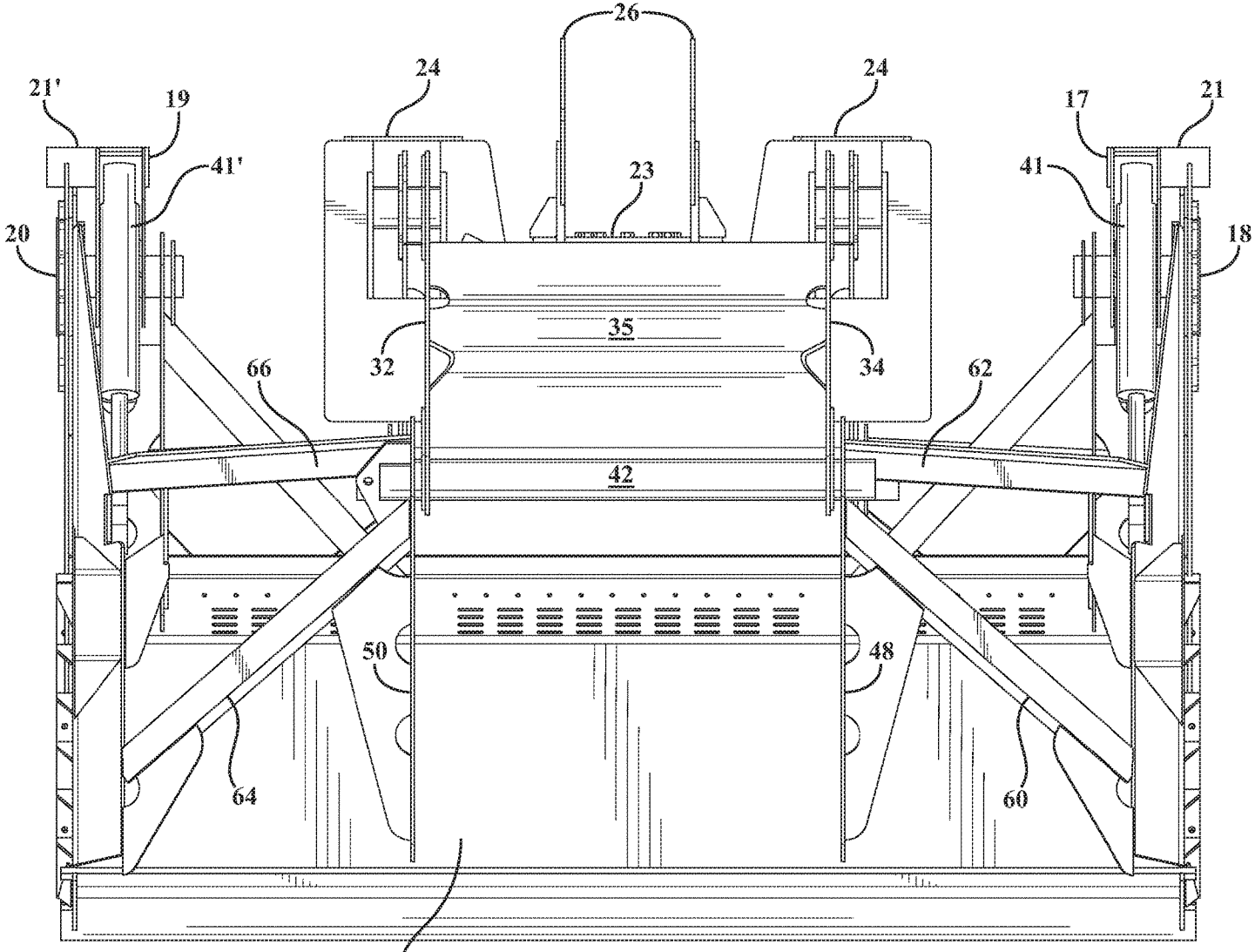
FIG. 3 is a front plan view of the clamshell dredging bucket of FIG. 1.
Figure 4:
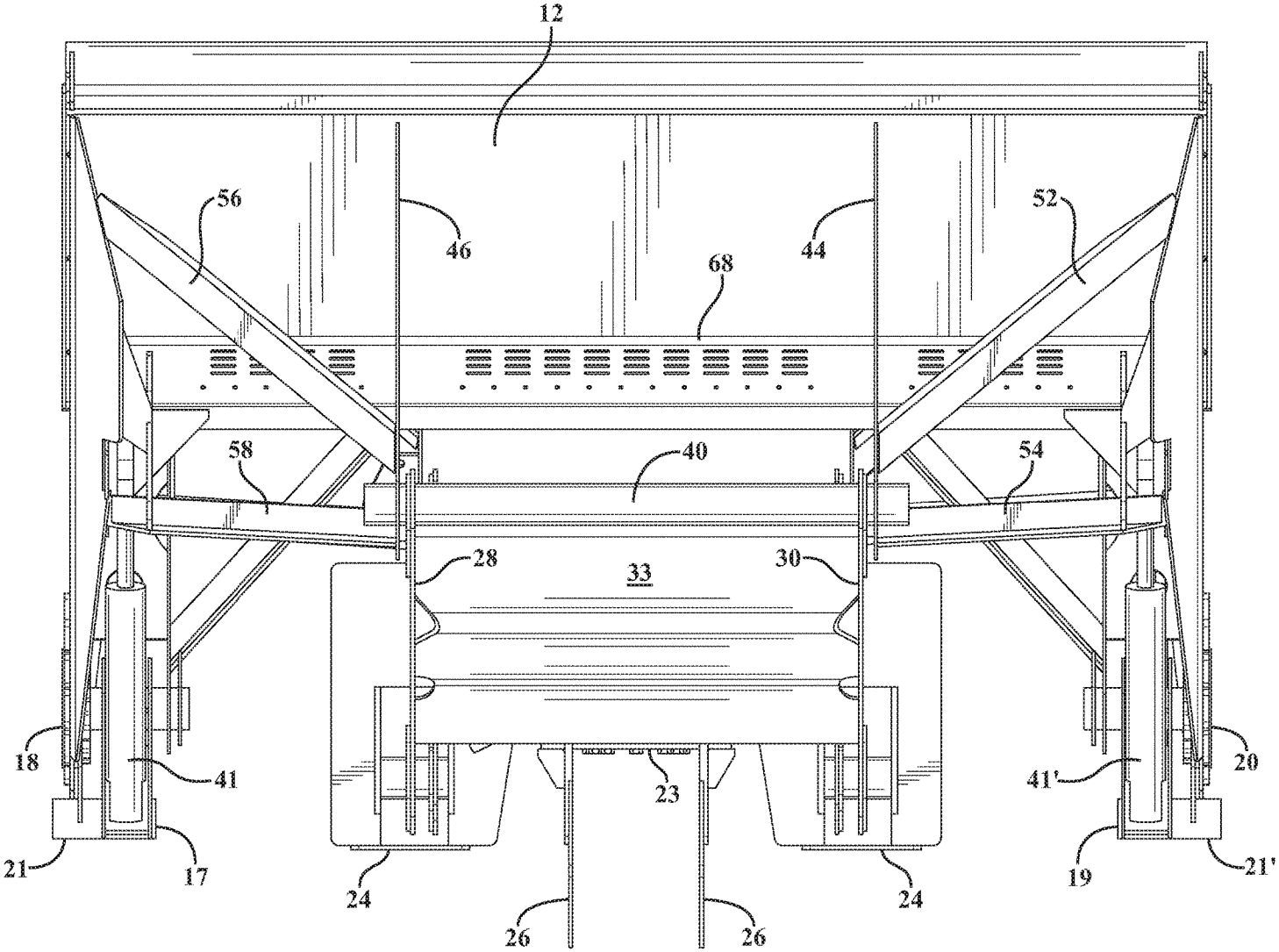
FIG. 4 is a rotated rear plan view of the clamshell dredging bucket of FIG. 1.
Figure 5:
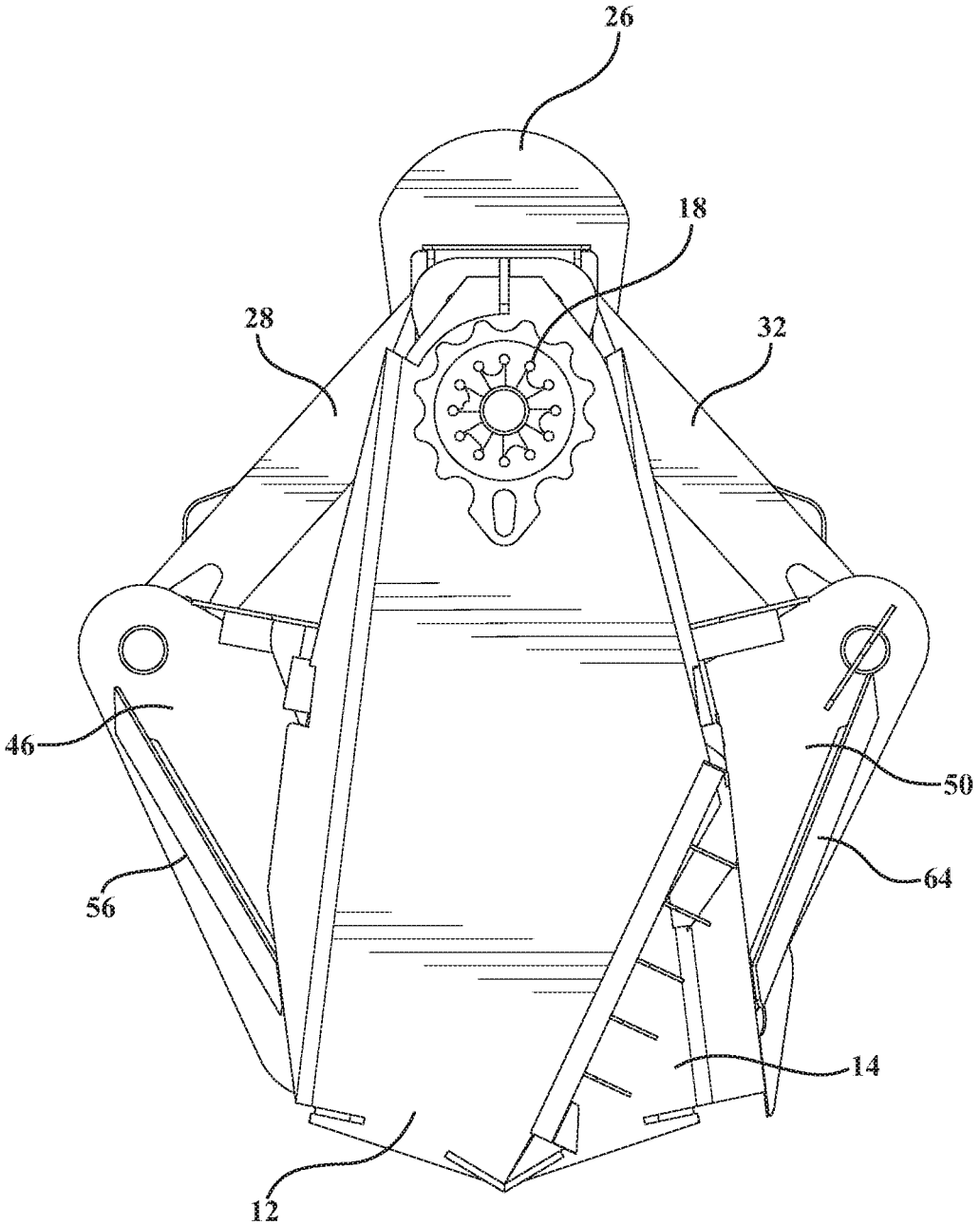
FIG. 5 is a right side plan view of the clamshell dredging bucket of FIG. 1.
Figure 6:
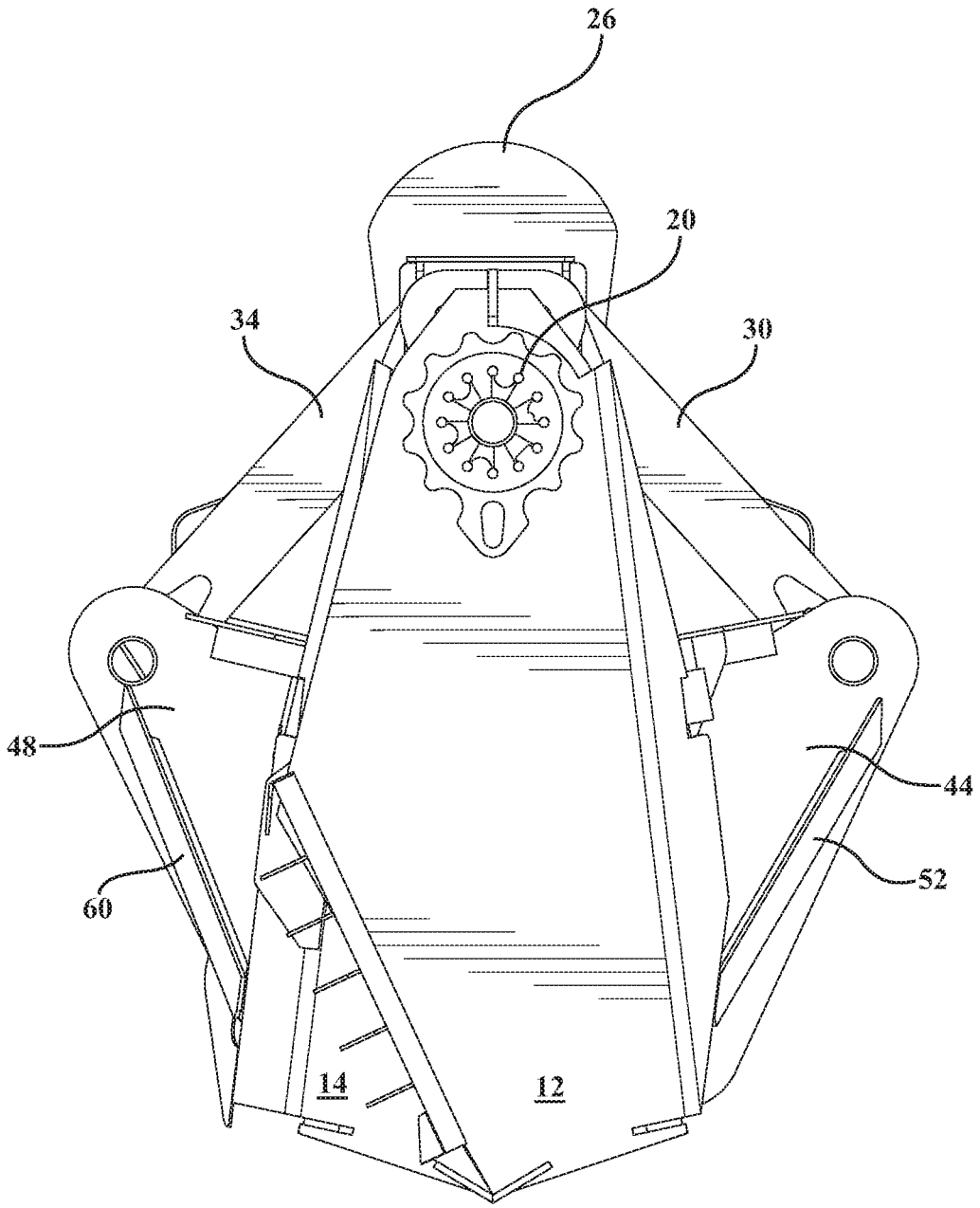
FIG. 6 is a left side plan view of the clamshell dredging bucket of FIG. 1.
Figure 7:
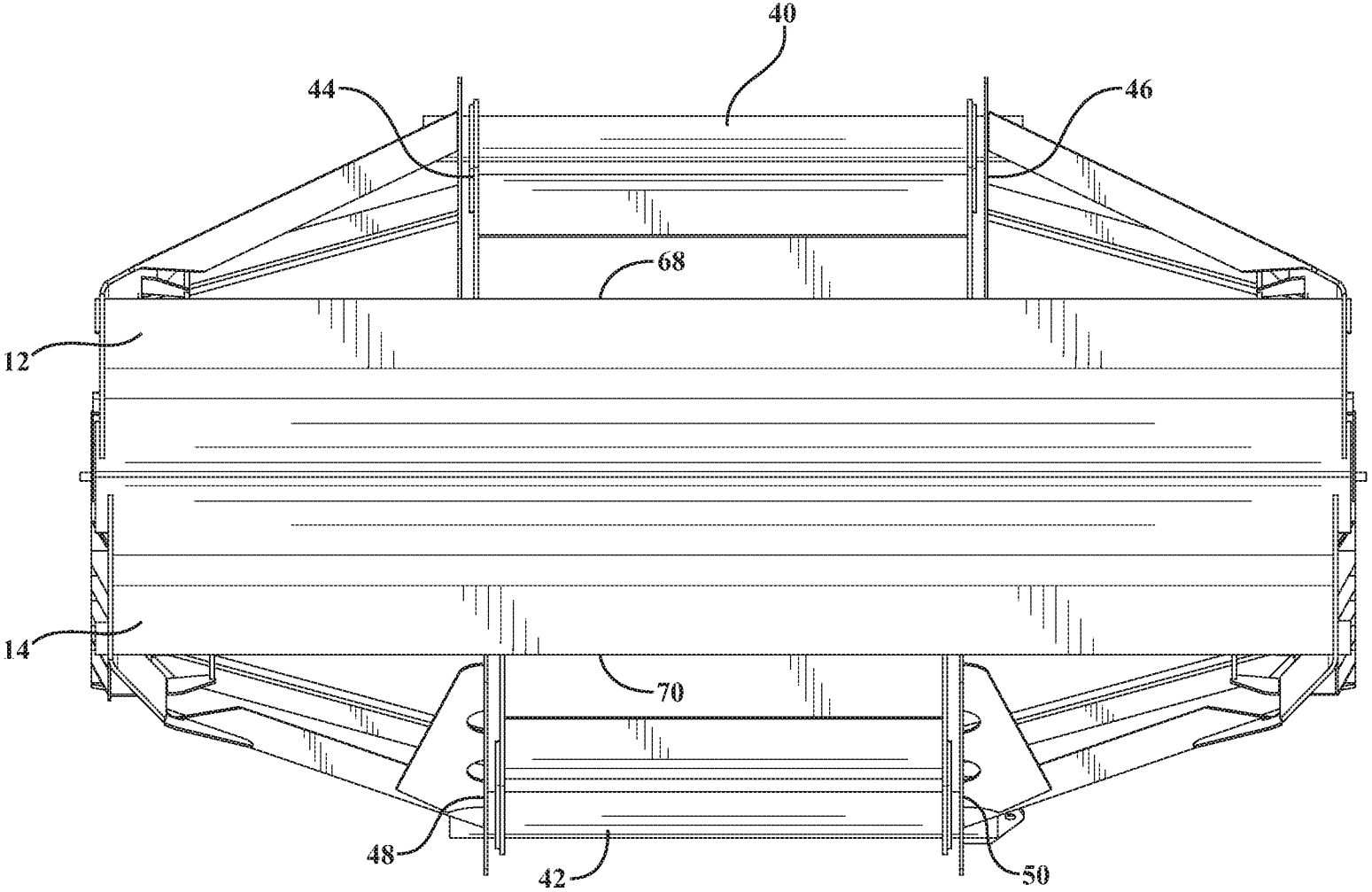
FIG. 7 is a bottom plan view of the clamshell dredging bucket of FIG. 1.
Figure 8:
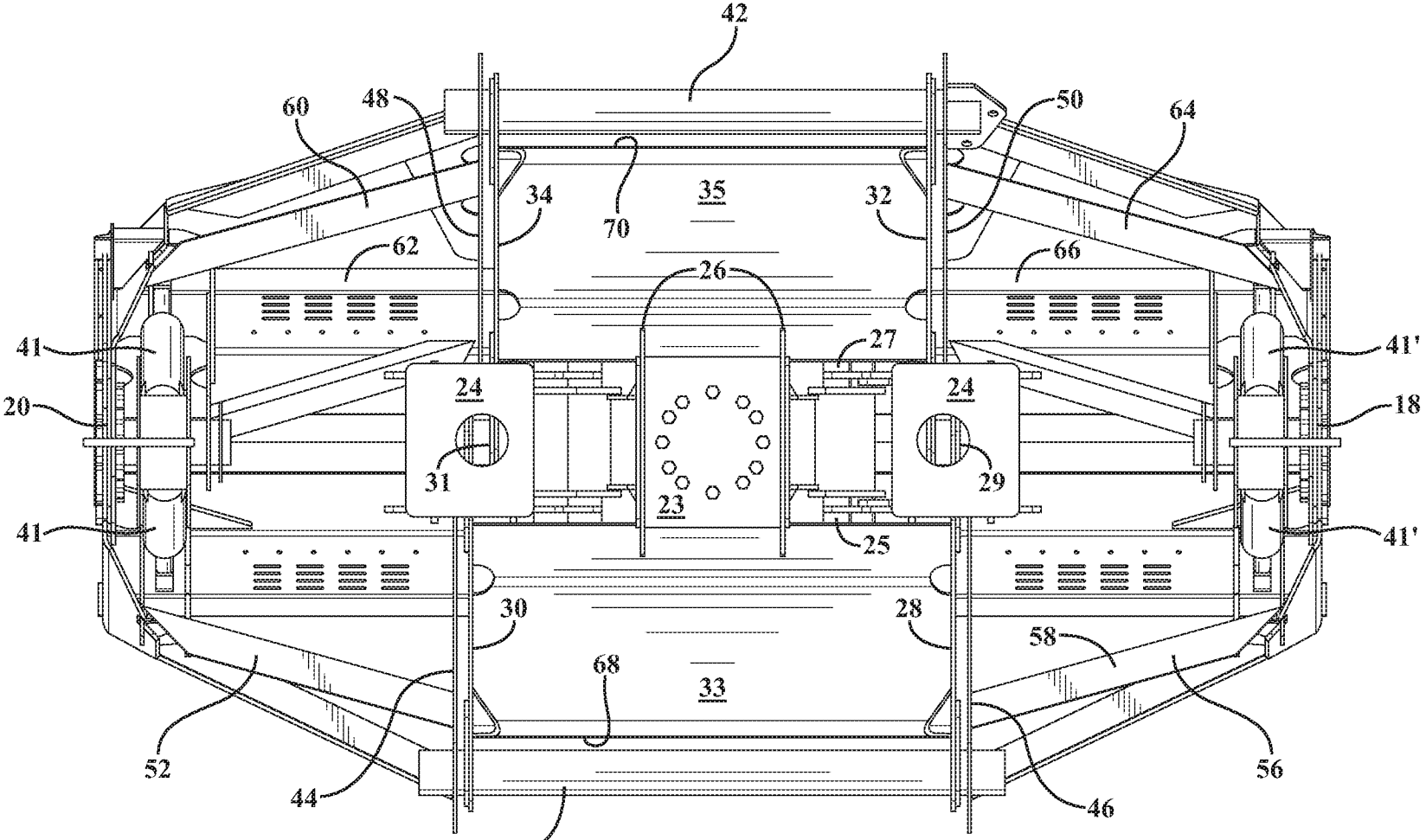
FIG. 8 is a top plan view of the clamshell dredging bucket of FIG. 1.

With reference to FIG. 1, a downward looking perspective is shown at 10 of a first variant of the clamshell dredging bucket according to the present invention. In combination with the succeeding views of FIGS. 2-11, subsequent description will focus on the shaping and configuration of the sides and ends of each pivotally interconnected bucket half, see further at 12 and 14 (as best shown in the open clamshell perspective of FIG. 9).

A brief structural description of the bucket assembly includes each bucket half 12/14 including length extending sides and overlapping ends. A pivot axis 16 for the bucket halves (see FIG. 1.) is defined by aligning bearing packages (see at 18 and 20) positioned at overlapping end locations (see also FIGS. 5-6) of the bucket halves 12/14. Also shown are end supported pairs of spaced brackets, see at 17 and 19 (these also termed T-links), which support associated bucket drive cylinders (described below at 41/41') and which extend from the T-links to engaging ends of the bucket halves, as shown at 45 in FIG. 1 for selected cylinder 41, to facilitate opening and closing of the same in normal power bucket operation. The operation of the T-links 17 and 19 will be described in more detail with subsequent reference to FIGS. 12-13 and by which the configuration of the stopping bars (see at 21 for T-link 17 and at 22 for T-link 19) limit the outward opening of the bucket halves 12/14.

Figure 15:
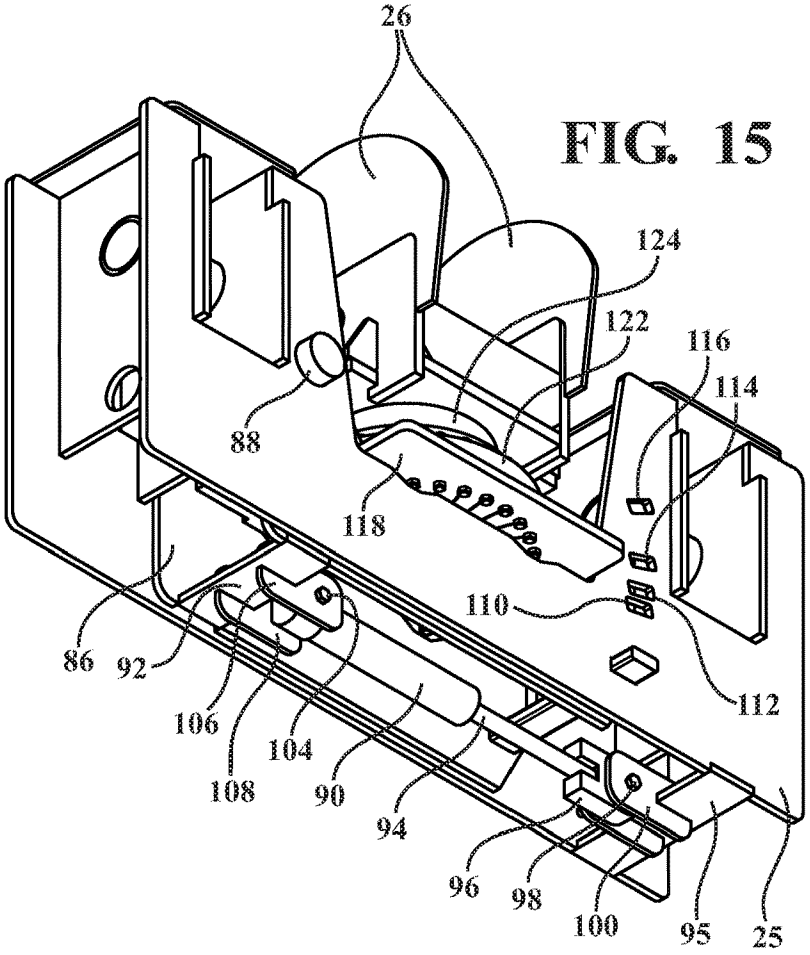
FIG. 15 is an underside rotated view of the head subassembly in FIG. 14 and better showing the hydraulic cylinder mounted between a rotatable inner support and outer pivotal support to which the upper ends of the bucket halves are in turn pivotally supported.

A head portion is defined as a generally rectangular three dimensional shaped body (see again as best shown by the open clamshell position of FIG. 9 and as will be further described with reference to succeeding views FIGS. 14-15). The head portion includes, without limitation, the central horizontal support plate similar to that shown previously at 23 in FIG. 1 and as further referenced at 118 in FIG. 14, this forming part of a rotational and tilting subassembly. Additional features include the reinforcing upper plates 24 and vertically extending top plates 26 (these including aperture mounts 26') for securing the assembly 10 to any of an overhead crane, dredging boom or the like, and for repetitive raising and lowering within a body of water for a typical sediment removal operation. The head portion also include side extending support plates 25/27 along with interconnecting end plates 29/31 as shown in FIG. 1 for establishing an overall rectangular configuration of the main or outer side or component 12 of the inner and outer clamshell bucket halves.

An actuating mechanism operates in combination with the bucket half drive cylinders 41/41' for opening and closing the bucket halves 12/14 relative to one another and about the main defined pivot axis 16. The actuating mechanism includes a first pair of arms 28/30 and a second pair of arms (at 32 in FIG. 1 and further at 34 in FIG. 9) which extend between support brackets 29/38 of the head portion 22 and elevated engagement supports 40/42 (these also termed tubular pins) secured in length extending fashion above the extending sides of the bucket halves. The pairs of arms 28/30 and 32/34 are each respectively supported by inner edge contacting reinforcement layers 33 and 35). The elongated supports 40/42 are in turn secured at opposite end by pairs of bracket plates, at 44/46 for bucket half 12 and further at 48/50 for bucket half 14, these projecting from the surfaces of the bucket halves and spacing the elongated supports 40/42 laterally outwardly from the bucket halves 12/14 as best shown in the closed end views of FIGS. 5-6.

The actuating mechanism further includes a plurality of hydraulic drive cylinders, only a pair of which are depicted again at 41 and 41' in FIG. 1. Selected cylinder 41 extends between a first pivotal mounting location 43 of the bucket end associated with selected T-link 17 the main pivot axis 16 and a second mounting location 45 at an intermediate end location of the bucket (in this instance bucket half 12). The hydraulic drive cylinders (such as which can include a total of four according to one non-limiting embodiment) can be operated by pressurized fluid connections extending from the associated excavator or crane attachment locations.

As further shown, pairs of angled reinforcement elongated brackets are provided which extend from outer end locations of each bucket half to reinforce the bracket plates 44/46 and 48/50, these depicted throughout FIGS. 1-11 by pairs of elongated reinforcement brackets 52/54 for plate 44, brackets 56/58 for plate 46, bracket 60/62 for plate 48 and 64/66 for plate 50. The weldment connections secure the bracket plates and attaching reinforcement brackets to lowermost positions on the bucket halves 12/14, and in particular to inwardly angled or arcuately bent locations which are configured underneath the upper integral portions of each bucket half, this being particularly depicted by weldment profile of bracket 46 shown in FIGS. 1-2 as further depicted in the enlarged sectional view of FIG. 10.

As previously described, the ability to relocate the weldment connections to lower/inwardly curved (i.e. underneath) positions along the bucket halves serves to modify the typically majority tensile forces exerted upon conventionally located higher/upper positioned bracket and support weldments for attaching the pivotally inducing arms, this by introducing a compressive force vector to the weldment connection owing to its lower/underneath location relative to an outermost contoured edge of each bucket half (see edge 68 for bucket half 12 as well as corresponding edge 70 for bucket half 14). As previously described, the ability to relocate the weldments connections to lower/inwardly angled or curved locations of the bucket halves serves to reinforce the weldment connections, in particular during closing of the bucket halves in a submerged sediment removal operation in which an obstacle such as a submerged tree trunk, rock etc., can become caught between the closing leading edges of the bucket halves (depicted at 72 for bucket half 12 and at 74 for bucket half 14 in the clamshell open position of FIG. 9), in these instances causing impact closing forces to be concentrated on the weldments thereby increasing instances of fracturing of the weldments. As further shown, the clamshell bucket halves, upon being closed, cause the edges 72/74 to overlap one another in order to assist in preventing loss of material through the closed bottom and sides of the bucket.

The steel construction and configuration of the bucket halves in the present design is further such that reductions of weight in the bucket halves, such as without limitation in ranges of 10-30% reduced weight from pre-existing designs of similar size, can be accomplished by utilizing steel plating of reduced thickness which is then bent to arcuate radiuses at the edges, and as opposed to utilizing conventional bending techniques which define sharper edge profiling in the bucket halves. The bucket halves are again depicted in FIG. 2 in an upward looking perspective of the clamshell dredging bucket of FIG. 1 and further illustrating the improved shaping and weldment techniques described herein.

Figure 10:
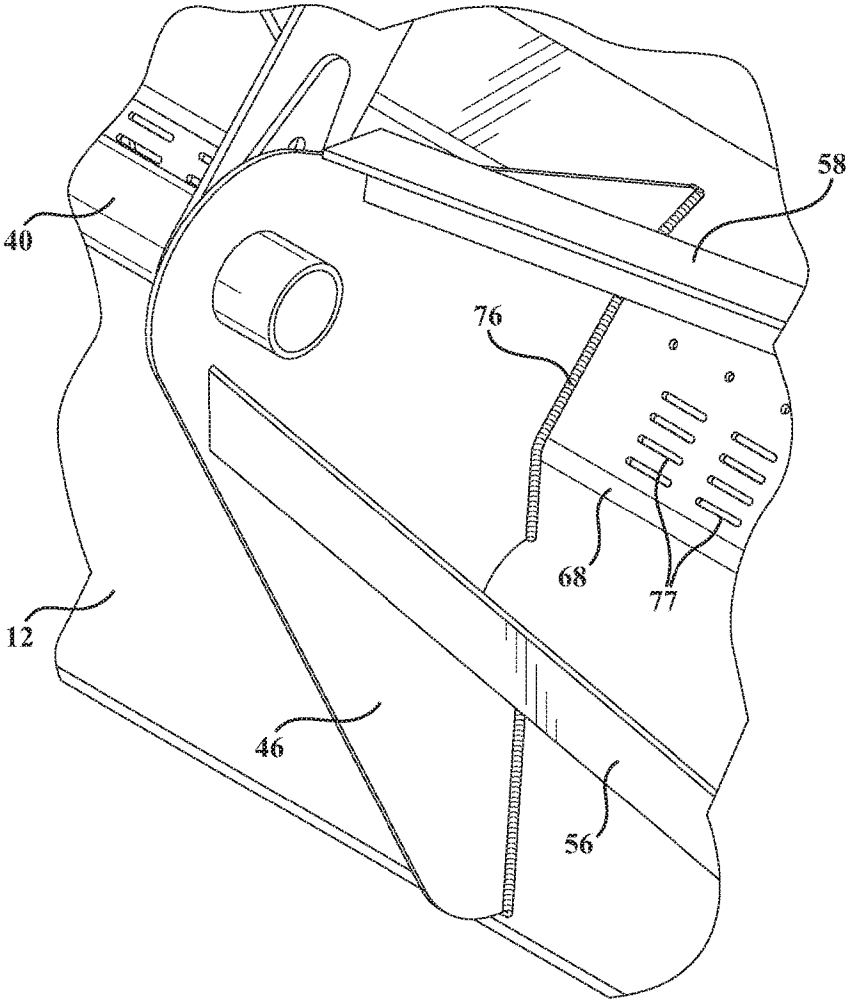
FIG. 10 is an enlarged perspective view of the weldment profile depicted in area 10 of FIG. 1.

FIG. 10 is an enlarged sectional view of a weldment profile 76 of the plate 46 depicted in area 10 of FIG. 1. As previously described, the weldment profile 76 is configured at a lower and inwardly curved location of the associated bucket half 12 in order to reinforce the engagement of the bracket plates to the bucket halves, again by introducing a compressive loading force vector owing to the underneath positioning of the weldment profile. Vents or apertures 77 can be formed in the top surfaces of the bucket halves 12/14 to minimize downward water pressure and for lowering instances of turbidity during lowering of the bucket. Additional dewatering vents can be provided with rubber seals to assist in faster drain-off of water once an ascending and sediment filled bucket breaks above the water surface.

Figure 9:
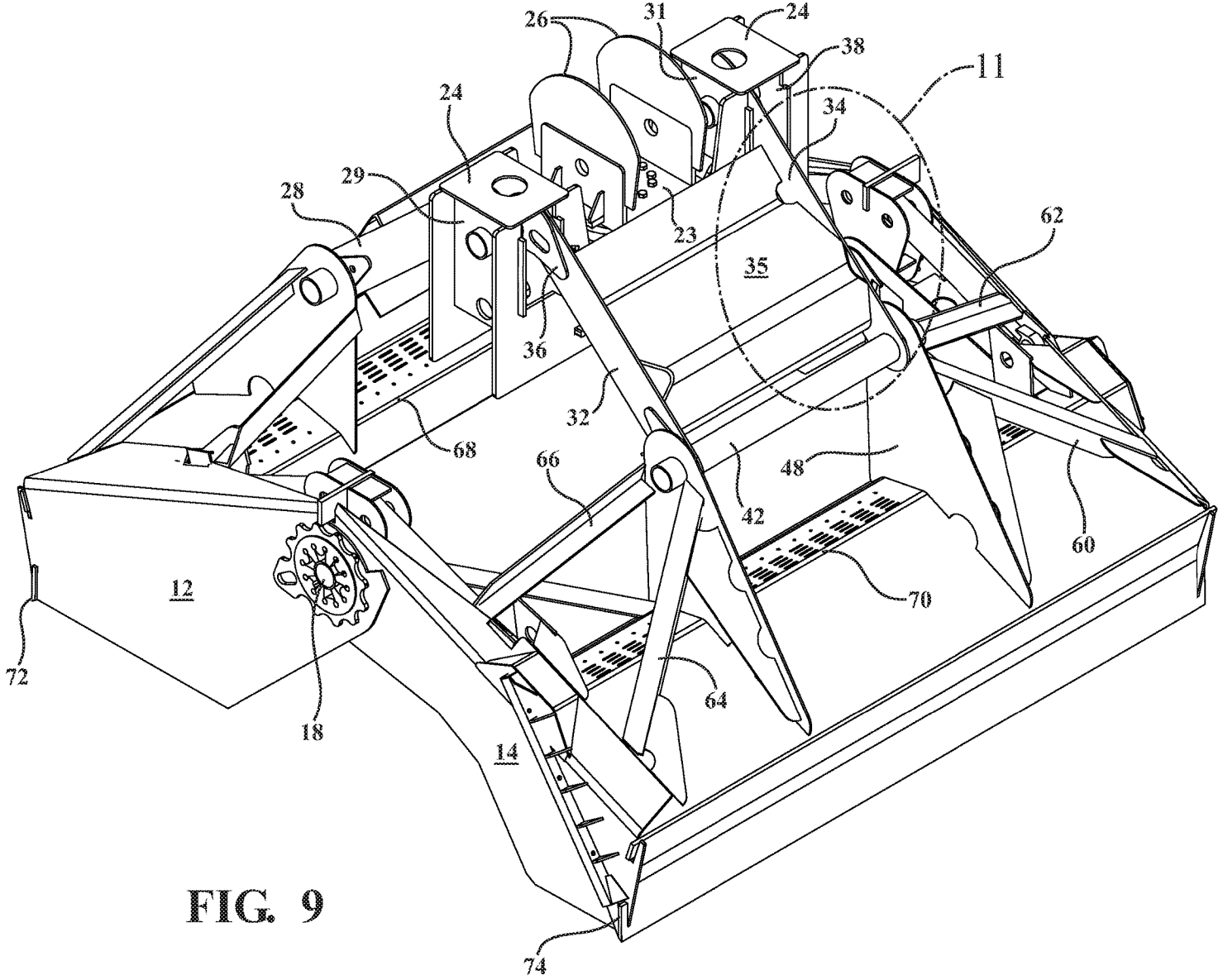
FIG. 9 is a further clamshell open perspective of the dredging bucket of FIG. 1.
Figure 11:
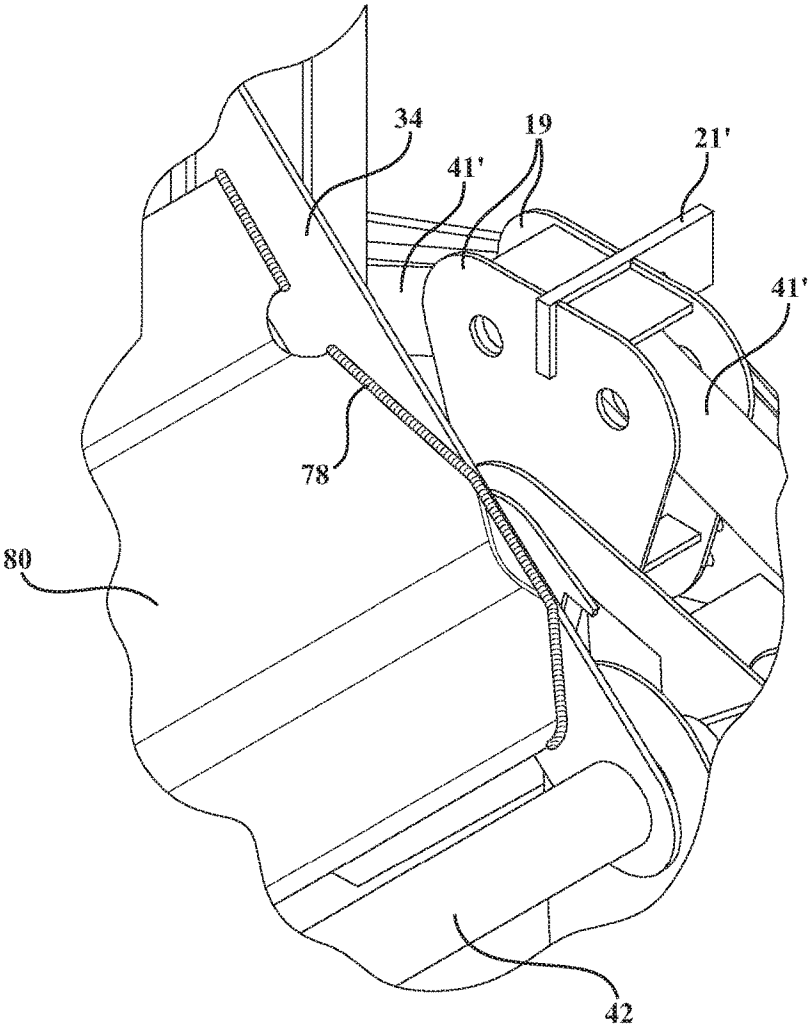
FIG. 11 is an enlarged sectional view of the weldment profile depicted in area 11 of FIG. 9.

FIG. 11 is an enlarged sectional view of another weldment profile 78 depicted in area 11 of FIG. 9 and which is associated with a representative connecting edge to reinforcing layer 35 extending between spaced apart arms 32 and 34 for bucket half 14 (a similar arrangement provided between spaced apart arms 28/30 for bucket half 12. As with weldment 76, the additional weldment profiles provide for a more robust connection between the various components of the bucket assembly and in order to both reduce the required overall weight of the bucket as well as incidences of weld fracture.

Figure 12:
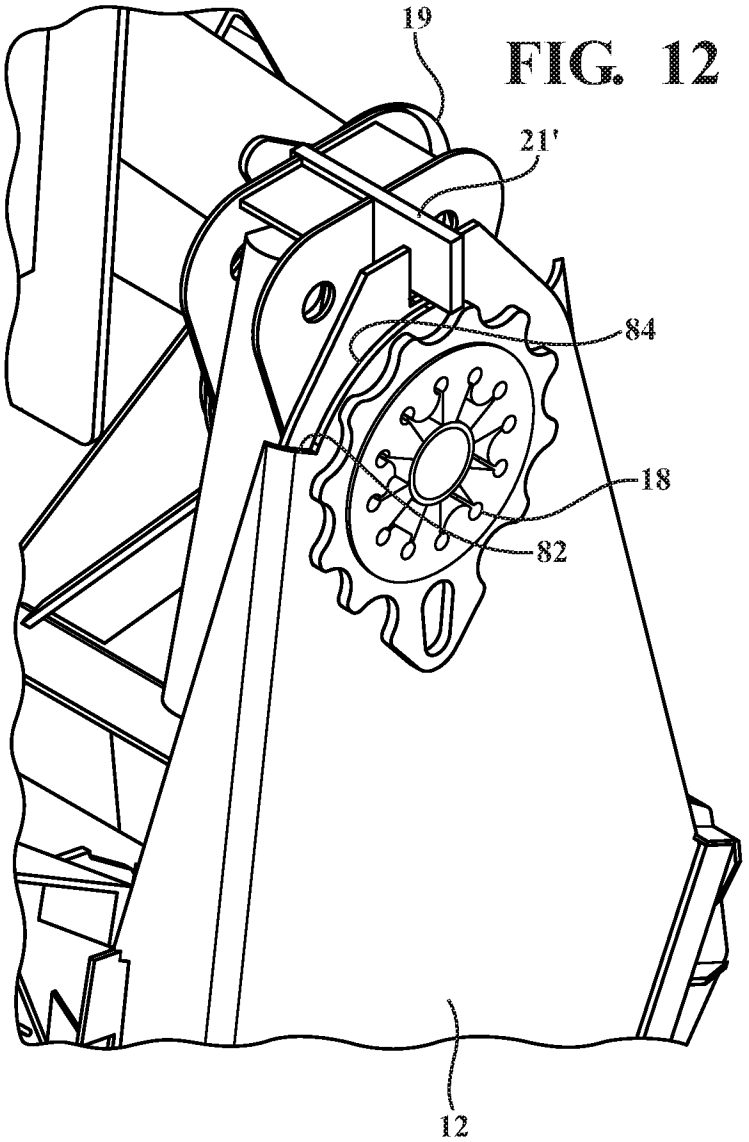
FIG. 12 is an enlarged perspective view of area 12 in FIG. 1 and better illustrating the relationship between the upper end supported T-links and the pivotally supported upper edge profiles of the bucket halves in the closed position.
Figure 13:
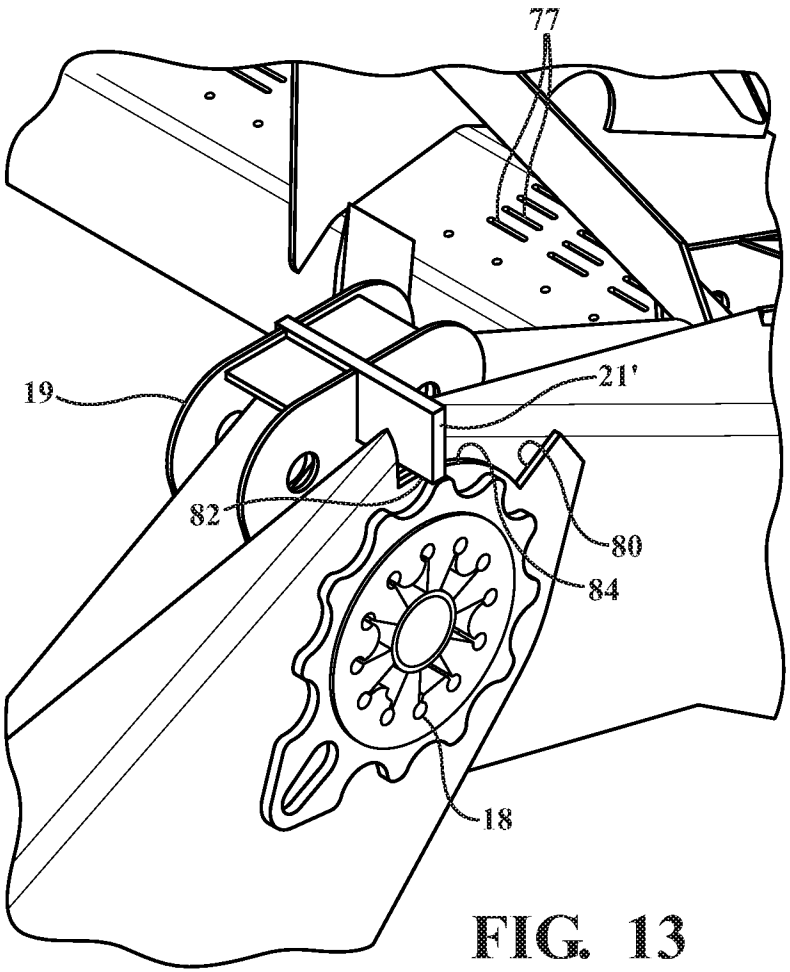
FIG. 13 is a succeeding illustration to FIG. 12 and illustrating the bucket halves rotated to the open position at which angled ends of the upper edge profiles of the bucket halves abut the stopping bar of the T-link in order to define a maximum degree of opening of the bucket halves.

Referring to FIG. 12, an enlarged perspective view is shown of area 12 in FIG. 1 and better illustrates the relationship between the upper end supported T-links (see again at 19) and the pivotally supported upper edge profiles of the bucket halves 12 and 14 in the closed position. FIG. 13 is a succeeding illustration to FIG. 12 and illustrating the bucket halves 12/14 rotated to the open position at which angled ends (shown at 80 and 82 for selected bucket half 12) are associated with upper edge profiles of the bucket halves (selected upper edge profile further being shown at 84 for bucket half 12 and largely hidden from view for the overlapped bucket half 14). The angled ends 80/82 define abutment ledges against which the stopping bars 21/21' of the T-links 17/19 contact in order to define both closed and maximum opened positions of the bucket halves. Without limitation, the range of rotation of each of the bucket halves 12/14 in the opening direction is designed not to over-extend the associated bucket drive cylinders 41/41' and can (without further limitation) be in the thirty to thirty five degree range to prevent blowout of the piston rods associated with the drive cylinders.

Figure 14:
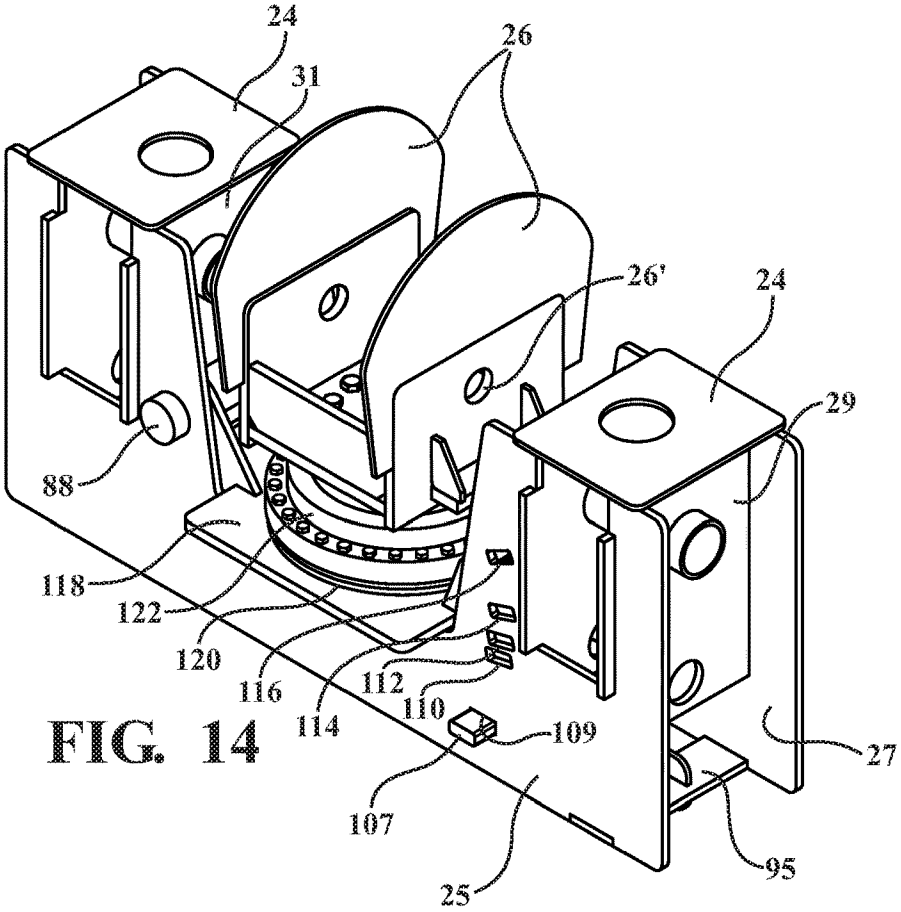
FIG. 14 is perspective illustration of the rotatable and angularly adjustable head subassembly for re-orienting the bucket halves to accommodate any desired dredging operation, such as including forming angled or side slopes in a channel dredging operation.

FIG. 14 is perspective illustration of the rotatable and angularly adjustable head subassembly for re-orienting the bucket halves 12/14 to accommodate any desired dredging operation, such as including forming angled or side slopes in a channel dredging operation. Identical components from FIG. 1 are repetitively numbered and, in combination with the underside view of FIG. 15, are again depicted by the rectangular three dimensional shaped body with side plates 25/27, end plates 29/31 and top plates 24, this defining an outer head which is angularly/tilt supported by an inner head 86 about a pivot point 88.

A tilt drive cylinder is provided and has a cylinder housing 90 secured to a crossbar 92 associated with the inner head 86. A piston 94 extends from the cylinder housing 90 to a crosswise extending reinforcement 95 of the outer head and which is represented by end support portion 96 of the piston 94 which is connected by a pin 98 extending between brackets 100/102. Likewise, a base of the cylinder housing 90 is connected via a similar pin 104 extending between brackets 106/108 extending from the inner head crossbar 92.

The outer head accordingly exerts a downward tilting compressive force relative to the inner head 86 about the pivot axis 88, this acting upon the piston 94 of the tilt drive cylinder 90 and so that a maximum extension of the piston 94 from the cylinder corresponds to a horizontal orientation (see in solid in FIG. 16) of the outer head relative to an inner head. A minimal extension of the piston further corresponds to a maximum downward angular tilt of the outer head (in phantom in FIG. 16) relative to the inner head.

Figure 16:
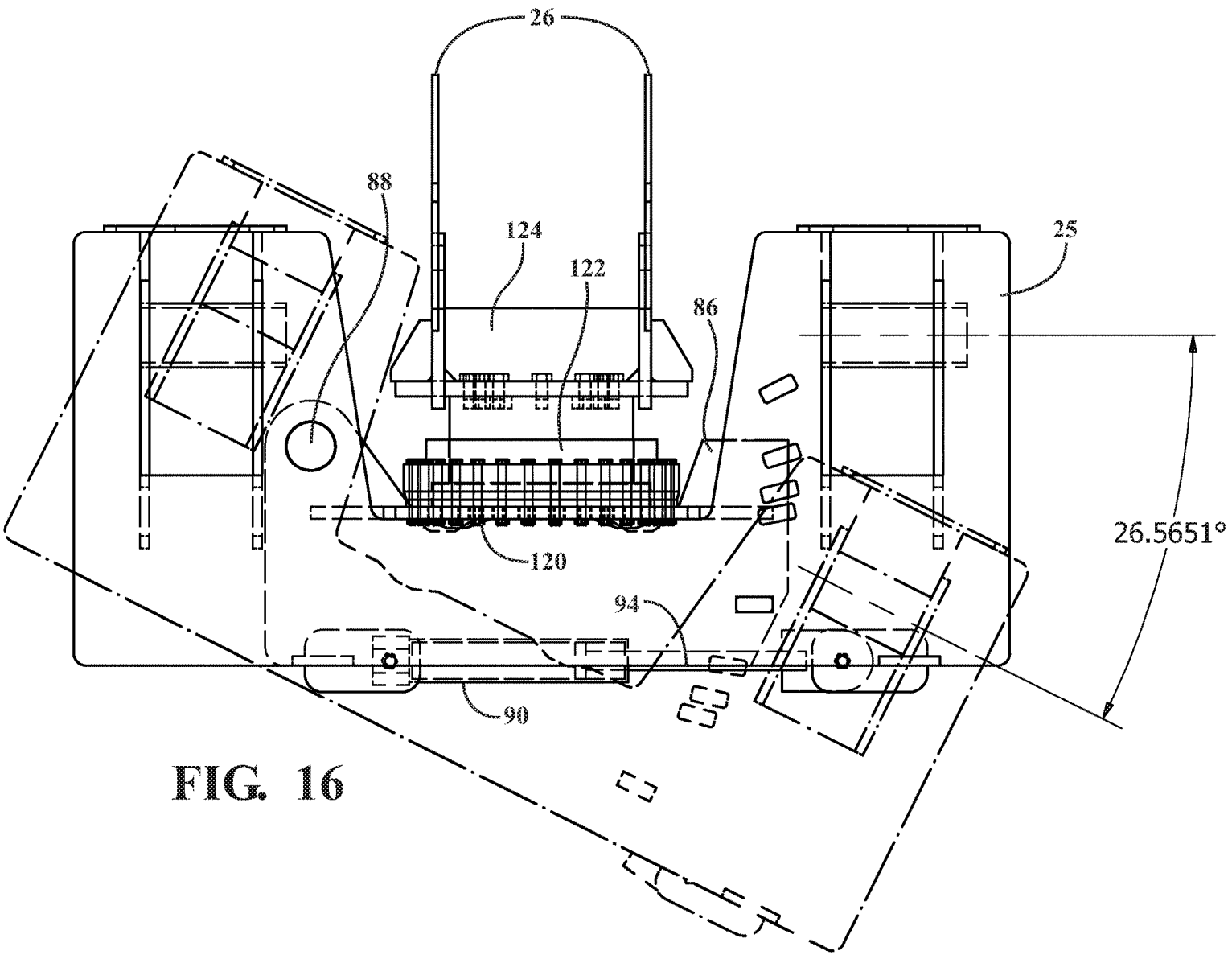
FIG. 16 is a plan view illustration of the head subassembly in FIGS. 14-15 and depicting a non-limiting range of pivotal adjustability of the outer head relative to the inner rotatably supported head.
Figure 17:
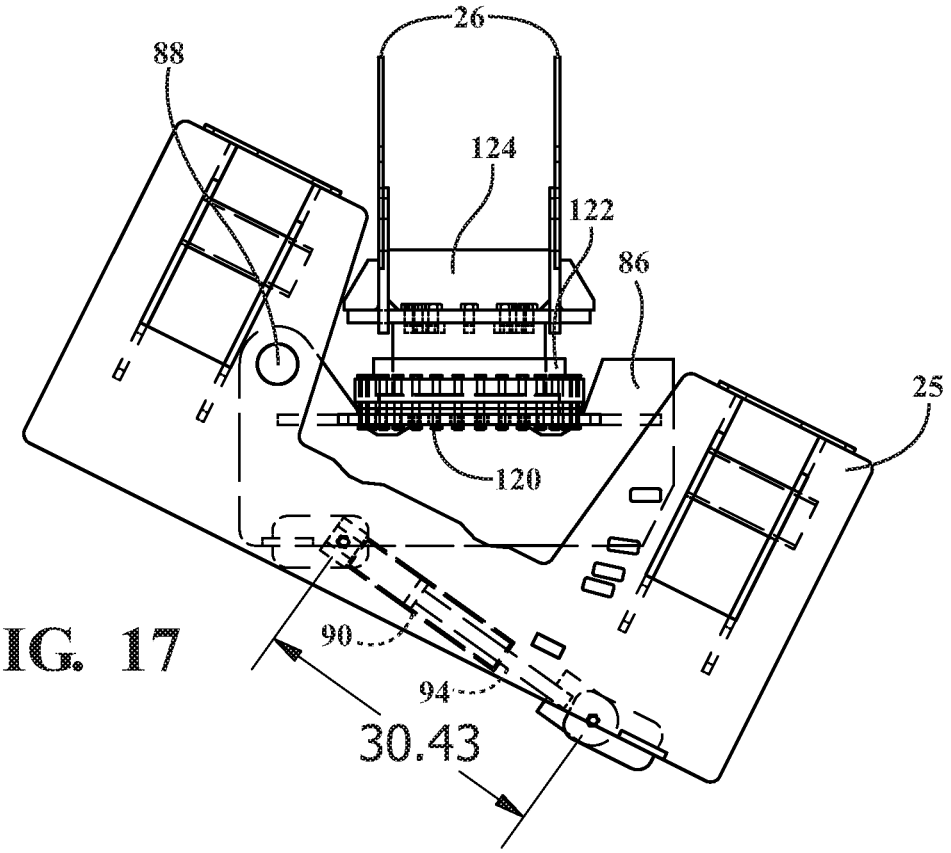
FIGS. 17-21 present a succession of views of the head subassembly as shown in FIG. 16 and depicting the variations in the angular repositioning of the outer head relative to the inner head and corresponding to a minimal extension of the underside cylinder in the maximum angled position of FIG. 17 to a maximum extension of the underside cylinder in the horizontal view of FIG. 21.
Figure 18:
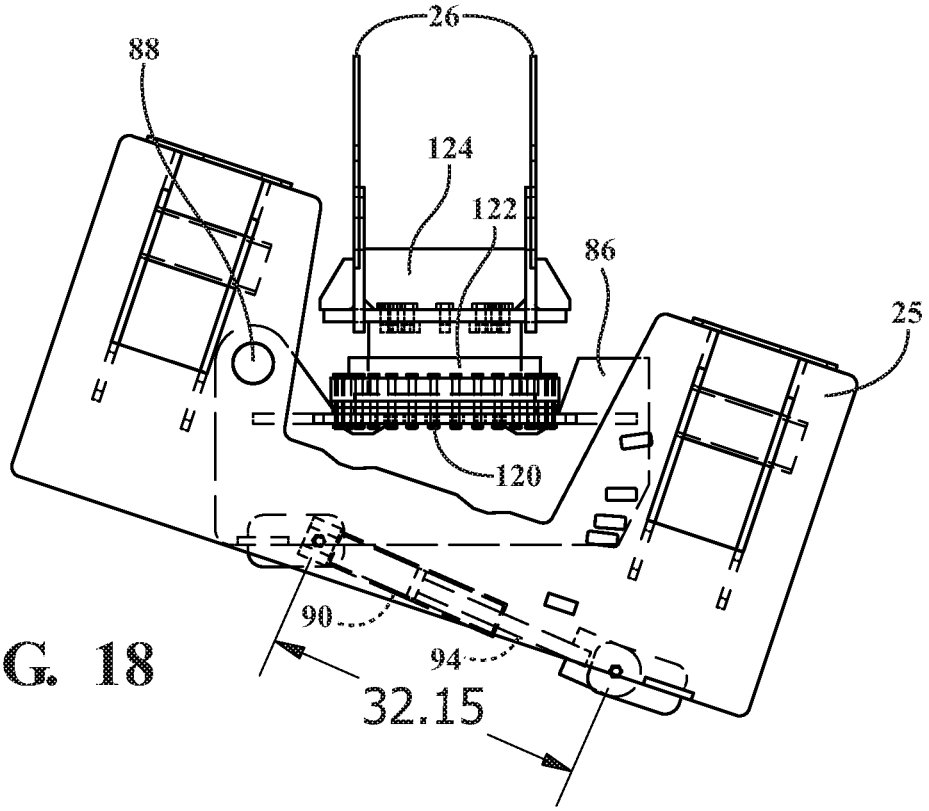
Figure 19:
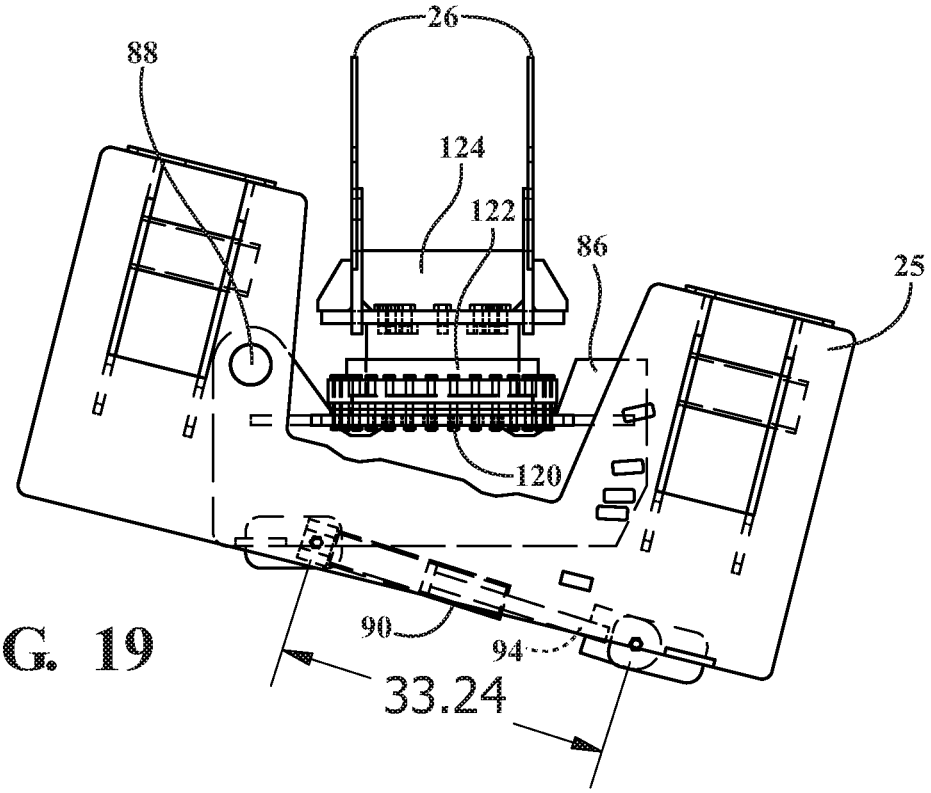
Figure 20:
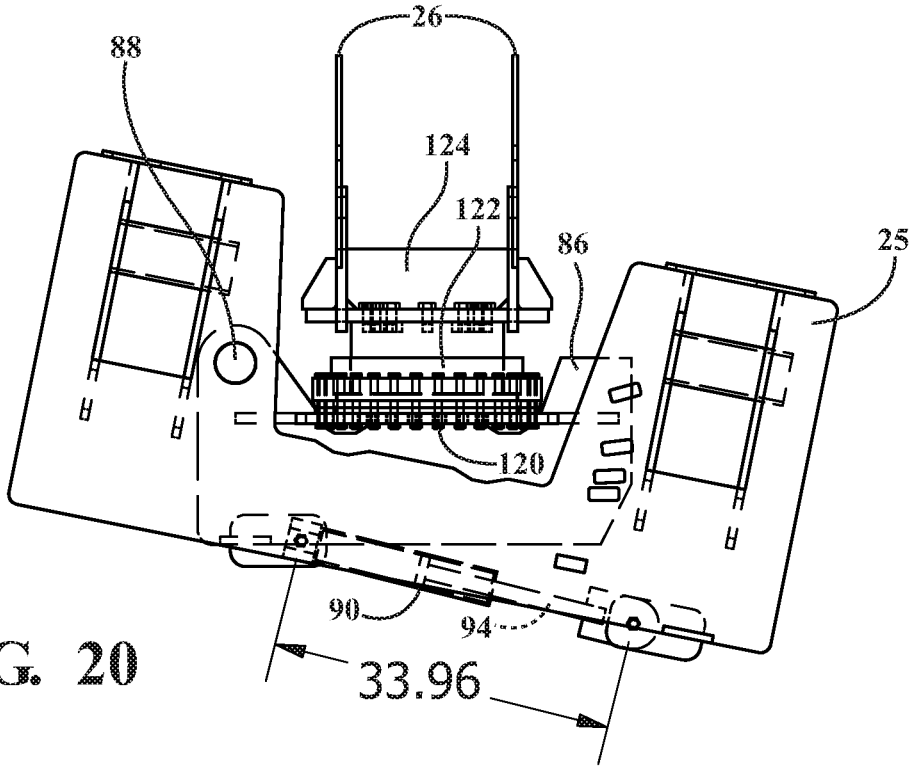
Figure 21:
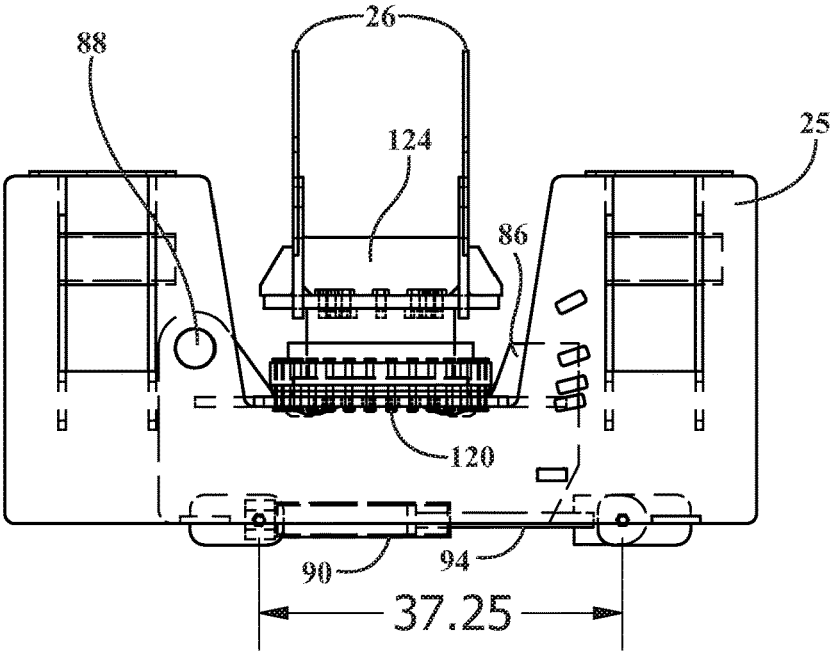

FIGS. 17-21 present a succession of views of the head subassembly as shown in FIG. 16 and depicting the variations in the angular repositioning of the outer head relative to the inner head. This corresponds to a minimal extension of the underside cylinder in the maximum angled position of FIG. 17 to a maximum extension of the underside cylinder in the horizontal view of FIG. 21. In this fashion, the tilting force of the outer head is always exerting an inward compressing force against the cylinder piston 94 to prevent disengagement.

The outer head can also be fixed at a desired angular position to the inner head via a locking bar 107 which can be engaged through aligning position apertures, a first of which depicted at 109 corresponding to a horizontal locked orientation of the outer head, with progressive locked tilt positions further represented by engagement apertures 110, 112, 114 and 116 shown for selected side plate 25. Although not shown, an aligning aperture pattern is shown in the opposite side plate 27. The inner head 86 also includes a width aperture for receiving the locking bar 107 upon the selected outer apertures 109 (position of FIGS. 14-15, 21), aperture 110 (position of FIG. 20), aperture 112 (position of FIG. 19), aperture 114 (position of FIG. 18), and aperture 116 (max downward tilt position of FIG. 17 and phantom representation of FIG. 16)

Referring again to FIGS. 14-15, the inner head 86 exhibits a generally three dimensional rectangular profile with a central support platform 118. A 360 degree rotational subassembly includes a first lower portion 120 incorporated into the central support platform, with a second upper portion 122 rotationally driving the lower portion 120 and inner head 86. The attachments to the upper portion, see again vertical spaced plates 26, are adapted to securing to an overhead supporting crane or dredging boom (not shown) for suspending the bucket 10.

Figure 22:
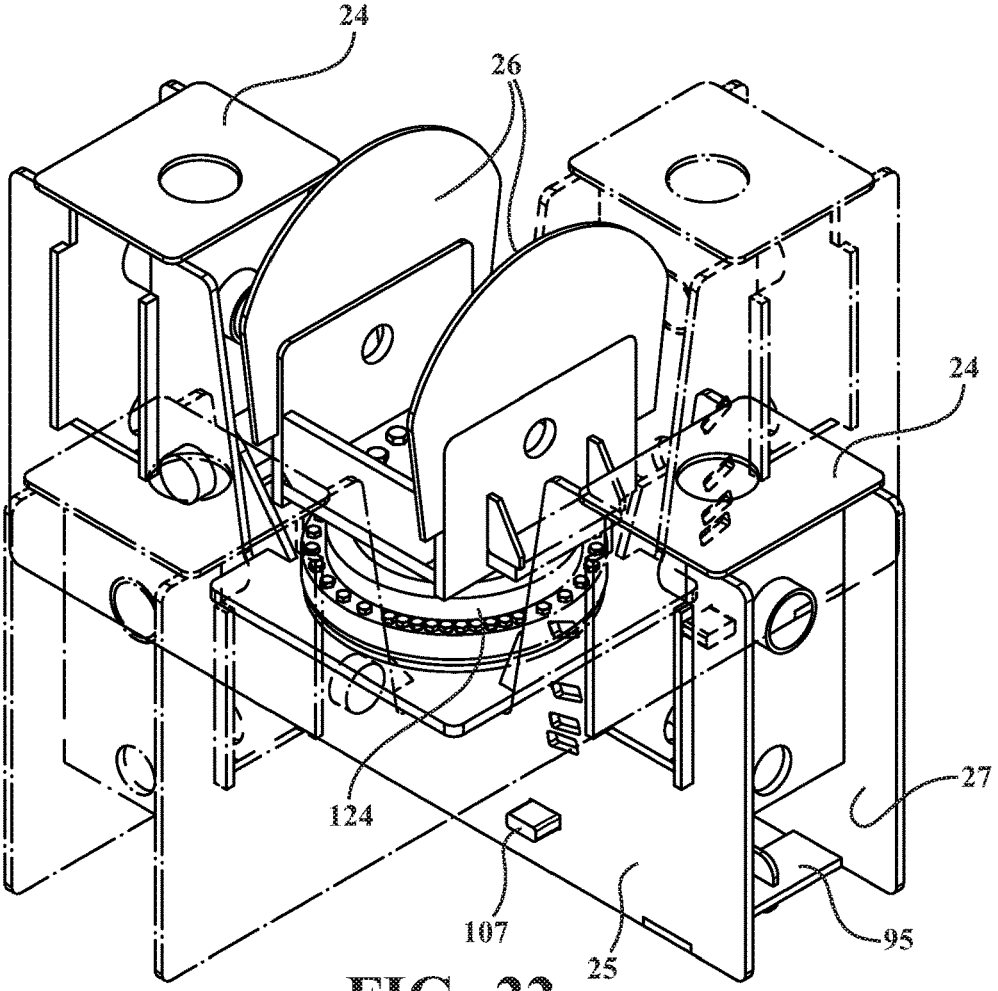
FIG. 22 is an illustration similar to FIG. 14 and depicting the rotational supporting and adjustable aspect of the inner head of the head subassembly.

Without limitation, the hookup connections from the associated power equipment (e.g. dredger or the like) can drive the rotation of the inner head and, by extension, the tilt supported outer head and bucket halves. FIG. 22 is an illustration similar to FIG. 14 and depicting the rotational supporting aspect of the inner head of the head subassembly with the vertical support plates 26 secured to a superstructure 124 of the upper rotation portion 122.

Figure 23:
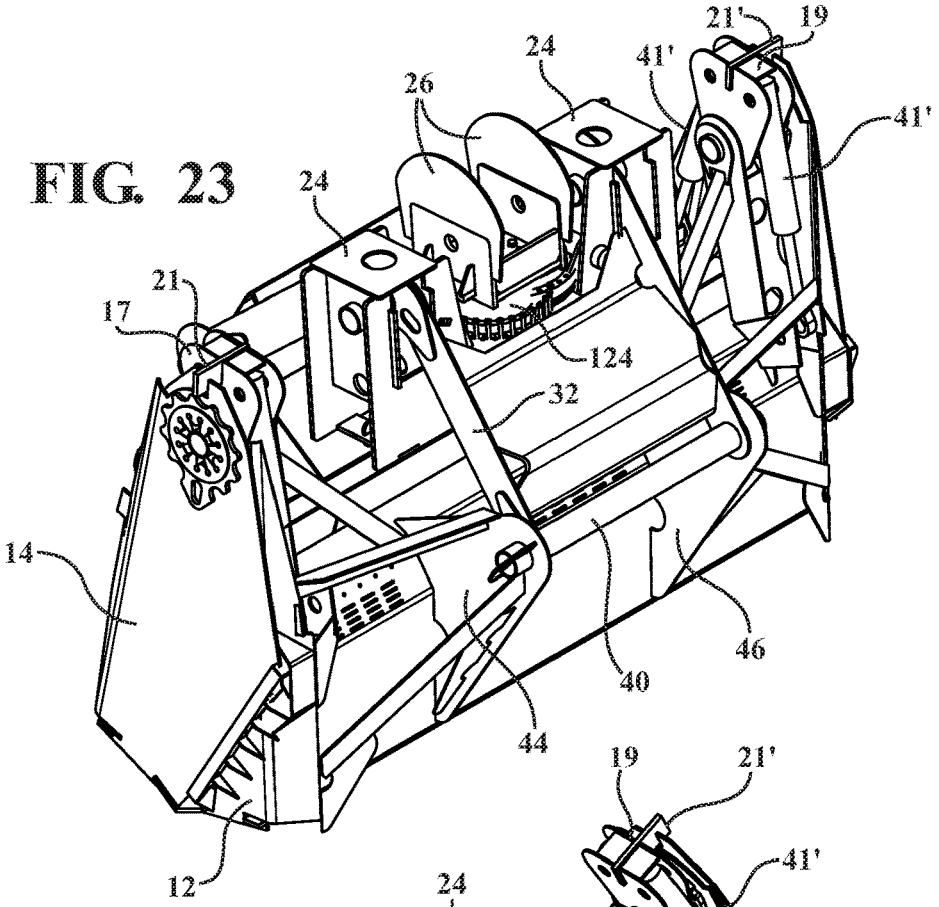
Figure 24:
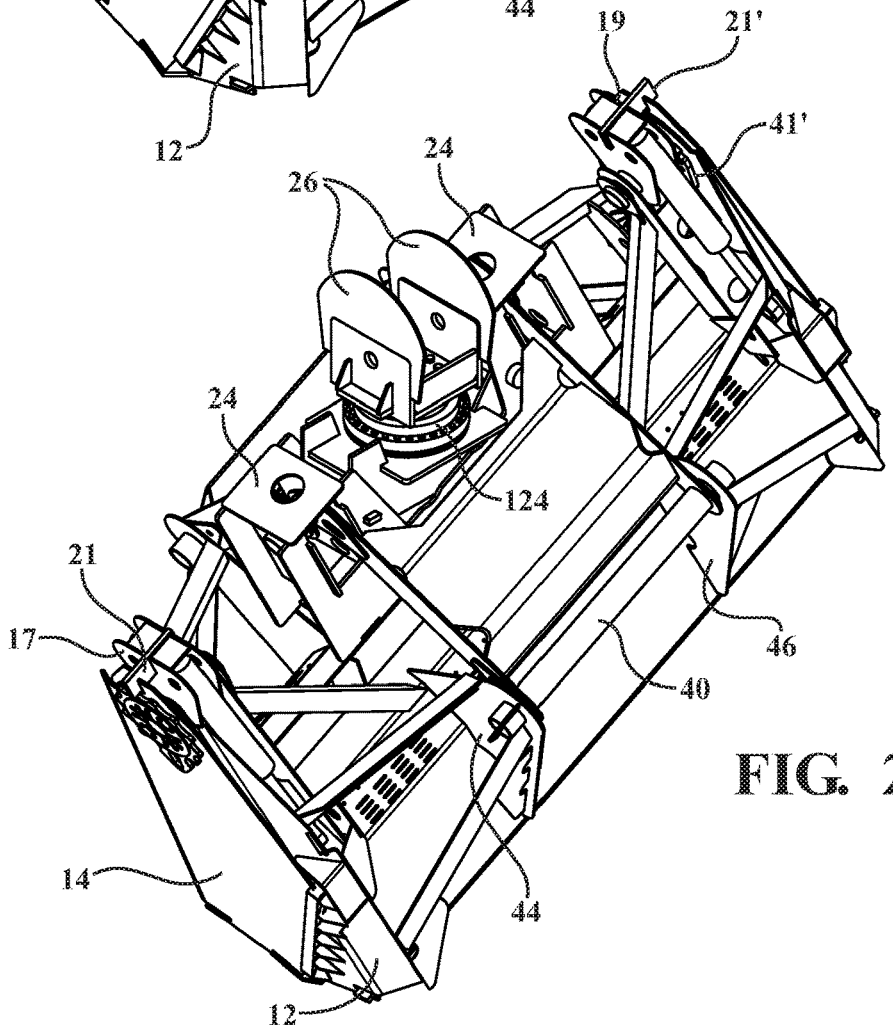

Finally, FIGS. 23-25 present a series of perspective view of a bucket assembly 200 according to a further related variant of the present invention with FIG. 26 presenting a side illustration of the bucket assembly in FIG. 23 and better showing the combination of the T-links 17 and 19 and bucket half support arms for supporting the first 12 and second 14 bucket halves between each of opened/separated and closed/overlapping positions. Consistent with the prior description, the crane or boom mounting brackets 26 are integrated into the upper superstructure 124 of the rotating platform of the inner head. The outer head is tilt supported to the inner head in the manner previously described and the bucket halves 12/14 are supported via the outer head between the open and closed positions.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A dredging bucket comprising:

a head subassembly including an inner rotatable head having an inner frame with a platform secured to an upper surface of said inner frame, inter-rotating portions supported upon said platform, a support plate secured to an upper of said inter-rotating portions and from which extend top plates adapted to mount said inner head to an overhead boom;

an outer head including an outer frame surrounding said inner frame, said outer head being angularly supported by said inner head via a pivot shaft between level and tilted orientations;

first and second opposing bucket halves supported by said outer head and pivotally actuating between closed and opened positions; and first and second pairs of spaced apart brackets affixed at upper supported ends of said outer head at spaced apart and coaxial pivot locations defined between said bucket halves, a central stopping bar extending between each of said pairs of brackets, each of said bucket halves having a curved upper edge profile with angled ends which abut said stopping bars and limits the open position of said bucket halves.

2. The invention as described in claim 1, further comprising a plurality of brackets extending from said outer frame and welded to each of said bucket halves for imparting a compressing loading vector to reduce instances of weldment fracture.

3. The invention as described in claim 2, said bucket halves each further comprising an arcuate bend profile across which said brackets and welds extend.

4. The invention as described in claim 2 further comprising any of a cable wheel or excavator attachment portion for suspending said inner head.

5. The invention as described in claim 1, said bucket halves including opposing and overlapping leading edge profiles for accomplishing level cut removal of sediment associated with a dredging operation.

6. The invention as described in claim 1, each of said bucket halves further exhibiting an increased width relative to an overall length for establishing an over square footprint in order to increase a sediment removal efficiency by maximizing an amount of sediment removed per scoop.

7. The invention as described in claim 1, further comprising apertures formed in upper locations of said bucket to minimize downward water pressure and for lowering instances of turbidity during lowering of the bucket.

8. The invention as described in claim 1, said first and second bucket halves further comprising overlapping side plates for minimizing windrowing of material during closing of the bucket as well as during return ascent from the water of the bucket.

9. The invention as described in claim 1, said bucket halves each further comprising an open center to increase lowering velocity of the bucket as it descends through the water to the sediment bottom allowing faster descent for more sediment removal scoops within a given time period.

10. The invention as described in claim 1, said bucket halves further comprising dewatering vents with rubber seals to assist in faster drain off of water once an ascending and sediment filled bucket breaks the water surface.

11. The invention as described in claim 1, said bucket halves each further including a level cut edge profile for minimizing removal depth of sediment per scoop.

12. The invention as described in claim 1, further comprising a tilt drive cylinder having a cylinder housing pivotally secured to said inner head, a piston extending from said cylinder housing to a crosswise extending reinforcement of said outer head.

13. The invention as described in claim 12, further comprising a pivot axis established by said pivot shaft between said inner and outer heads, a downward tilting force exerted by said outer head upon said pivot axis exerting a compressing force upon said piston of said tilt drive cylinder so that a maximum extension of said piston from said cylinder housing corresponds to a horizontal orientation of said outer head relative to said inner head, with a minimal extension of said piston further corresponding to a maximum downward angular tilt of said outer head relative to said inner head.

14. The invention as described in claim 1, said outer frame further comprising pairs of arms pivotally supported to said inner frame and engaging elongated supports of said bucket halves.

15. The invention of claim 14, further comprising pairs of bracket plates extending from each of said bucket halves for securing said elongated supports, individual pairs of elongated reinforcement brackets extending between said bucket halves and said bracket plates.

* * * * *